US005970152A

United States Patent [19]

Klayman

[11] Patent Number: 5,970,152

[45] Date of Patent: Oct. 19, 1999

[54] AUDIO ENHANCEMENT SYSTEM FOR USE IN A SURROUND SOUND ENVIRONMENT

[75] Inventor: Arnold I. Klayman, Huntington Beach, Calif.

[73] Assignee: SRS Labs, Inc., Irvine, Calif.

[21] Appl. No.: 08/641,319

[22] Filed: Apr. 30, 1996

[51] Int. Cl.[6] ..... H04R 5/00

[52] U.S. Cl. ..... 381/1; 381/22; 381/27

[58] Field of Search ..... 381/27, 19, 20, 381/21, 22, 23, 1, 17, 18

[56] References Cited

U.S. PATENT DOCUMENTS

| | | |
|---|---|---|
| 3,229,038 | 1/1966 | Richter . |
| 3,246,081 | 4/1966 | Edwards . |
| 3,249,696 | 5/1966 | Van Sickle . |
| 3,665,105 | 5/1972 | Chowning . |
| 3,697,692 | 10/1972 | Hafler . |

(List continued on next page.)

FOREIGN PATENT DOCUMENTS

| | | |
|---|---|---|
| 0 097 982 A3 | 1/1984 | European Pat. Off. . |
| 0 312 406 A2 | 4/1989 | European Pat. Off. . |
| 0 320 270 A2 | 6/1989 | European Pat. Off. . |
| 0 354 517 A2 | 2/1990 | European Pat. Off. . |
| 0 357 402 A2 | 3/1990 | European Pat. Off. . |
| 0 526 880 A2 | 2/1993 | European Pat. Off. . |
| 0 637 191 A2 | 2/1995 | European Pat. Off. . |
| 0 699 012 A2 | 2/1996 | European Pat. Off. . |

(List continued on next page.)

OTHER PUBLICATIONS

Kaufman, "Frequency Contouring For Image Enhancement," *AUDIO,* Feb. 1985, pp. 34–39.

Schroeder, M.R., "An Artificial Stereophonic Effect Obtained from a Single Audio Signal", *Journal of the Audio Engineering Society,* vol. 6, No. 2, pp. 74–79, Apr. 1958.

Kurozumi, K., et al., "A New Sound Image Broadening Control System Using a Correlation Coefficient Variation Method", *Electronics and Communications in Japan,* vol. 67–A, No. 3, pp. 204–211, Mar. 1984.

Sundberg, J., "The Acoustics of the Singing Voice", *The Physics of Music,* pp. 16–23, 1978.

Ishihara, M., "A New Analog Signal Processor For A Stereo Enhancement System", *IEEE Transactions on Consumer Electronics,* vol. 37, No. 4, pp. 806–813, Nov. 1991.

Allison, R., "The Loudspeaker / Living Room System", *Audio,* pp. 18–22, Nov. 1971.

Vaughan, D., "How We Hear Direction", *Audio,* pp. 51–55, Dec. 1983.

Stevens, S., et al., "Chapter 5: The Two–Earned Man", *Sound And Hearing,* pp. 98–106, and 196, 1965.

Eargle, J. "Multichannel Stereo Matrix Systems: An Overview", *Journal of the Audio Engineering Society,* pp. 552–558 (no date listed).

Wilson, Kim, "AC–3 Is Here! But Are You Ready To Pay The Price?", *Home Theater,* pp. 60–65, Jun. 1995.

*Primary Examiner*—Vivian Chang

*Attorney, Agent, or Firm*—Knobbe, Martens, Olson & Bear LLP

[57] ABSTRACT

An audio enhancement system and method for use in a surround sound environment creates a more diffuse and continuous sound field from a multi-channel, multi-speaker reproduction environment. Multiple audio source signals generated from an audio recording, which are intended for speakers placed in front of and behind a listener, are isolated into pairs and processed to create corresponding pairs of component audio signals. Each pair of component audio signals is generated, at least in part, from the information present in both corresponding audio source signals. The individual component audio signals are then selectively combined to form enhanced output signals so that each enhanced output signal is modified as function of a plurality of audio source signals.

37 Claims, 8 Drawing Sheets

U.S. PATENT DOCUMENTS

| | | |
|---|---|---|
| 3,725,586 | 4/1973 | Iida . |
| 3,745,254 | 7/1973 | Ohta et al. . |
| 3,757,047 | 9/1973 | Ito et al. . |
| 3,761,631 | 9/1973 | Ito et al. . |
| 3,772,479 | 11/1973 | Hilbert . |
| 3,849,600 | 11/1974 | Ohshima . |
| 3,885,101 | 5/1975 | Ito et al. . |
| 3,892,624 | 7/1975 | Shimada . |
| 3,925,615 | 12/1975 | Nakano . |
| 3,943,293 | 3/1976 | Bailey . |
| 4,024,344 | 5/1977 | Dolby et al. . |
| 4,063,034 | 12/1977 | Peters . |
| 4,069,394 | 1/1978 | Doi et al. . |
| 4,118,599 | 10/1978 | Iwahara et al. . |
| 4,139,728 | 2/1979 | Haramoto et al. . |
| 4,192,969 | 3/1980 | Iwahara . |
| 4,204,092 | 5/1980 | Bruney . |
| 4,209,665 | 6/1980 | Iwahara . |
| 4,218,583 | 8/1980 | Poulo . |
| 4,219,696 | 8/1980 | Kogure et al. . |
| 4,237,343 | 12/1980 | Kurtin et al. . |
| 4,303,800 | 12/1981 | DeFreitas . |
| 4,308,423 | 12/1981 | Cohen . |
| 4,308,424 | 12/1981 | Bice, Jr. . |
| 4,309,570 | 1/1982 | Carver . |
| 4,332,979 | 6/1982 | Fischer . |
| 4,349,698 | 9/1982 | Iwahara . |
| 4,355,203 | 10/1982 | Cohen . |
| 4,356,349 | 10/1982 | Robinson . |
| 4,393,270 | 7/1983 | Van Den Berg . |
| 4,394,536 | 7/1983 | Shima et al. . |
| 4,408,095 | 10/1983 | Ariga et al. . |
| 4,479,235 | 10/1984 | Griffis . |
| 4,489,432 | 12/1984 | Polk . |
| 4,495,637 | 1/1985 | Bruney . |
| 4,497,064 | 1/1985 | Polk . |
| 4,503,554 | 3/1985 | Davis . |
| 4,567,607 | 1/1986 | Bruney et al. . |
| 4,569,074 | 2/1986 | Polk . |
| 4,589,129 | 5/1986 | Blackmer et al. . |
| 4,594,610 | 6/1986 | Patel . |
| 4,594,729 | 6/1986 | Weingartner . |
| 4,594,730 | 6/1986 | Rosen . |
| 4,622,691 | 11/1986 | Tokumo et al. . |
| 4,648,117 | 3/1987 | Kunugi et al. . |
| 4,696,036 | 9/1987 | Julstrom . |
| 4,703,502 | 10/1987 | Kasai et al. . |
| 4,748,669 | 5/1988 | Klayman . |
| 4,856,064 | 8/1989 | Iwamatsu . |
| 4,866,774 | 9/1989 | Klayman . |
| 4,866,776 | 9/1989 | Kasai et al. . |
| 4,888,809 | 12/1989 | Knibbeler . |
| 4,953,213 | 8/1990 | Tasaki et al. . |
| 5,033,092 | 7/1991 | Sadaie . |
| 5,046,097 | 9/1991 | Lowe et al. . |
| 5,105,462 | 4/1992 | Lowe et al. . |
| 5,146,507 | 9/1992 | Satoh et al. . |
| 5,208,860 | 5/1993 | Lowe et al. . |
| 5,228,085 | 7/1993 | Aylward . |
| 5,251,260 | 10/1993 | Gates . |
| 5,255,326 | 10/1993 | Stevenson . |
| 5,325,435 | 6/1994 | Date et al. . |
| 5,371,799 | 12/1994 | Lowe et al. . |
| 5,533,129 | 7/1996 | Gefvert . |
| 5,572,591 | 11/1996 | Numazu et al. ..... 381/18 |

FOREIGN PATENT DOCUMENTS

| | | |
|---|---|---|
| 35 014 | 2/1966 | Finland . |
| 33 31 352 A1 | 3/1985 | Germany . |
| 40-29936 | 10/1940 | Japan . |
| 43-12585 | 5/1943 | Japan . |
| 58-144989 | 9/1983 | Japan . |
| 59-27692 | 2/1984 | Japan . |
| 61-33600 | 2/1986 | Japan . |
| 61-166696 | 10/1986 | Japan . |
| 2 154 835 | 9/1985 | United Kingdom . |
| 2 277 855 | 8/1994 | United Kingdom . |
| WO 87/06090 | 10/1987 | WIPO . |
| WO 91/19407 | 12/1991 | WIPO . |

AUDIO ENHANCEMENT SYSTEM FOR USE IN A SURROUND SOUND ENVIRONMENT

BACKGROUND OF THE INVENTION

This invention relates generally to audio enhancement systems and methods for improving the realism and dramatic effects obtainable from stereo sound reproduction. More particularly, this invention relates to apparatus and methods for enhancing sound generated in a surround sound environment having separate front and rear audio channels.

The advent of stereo surround-sound audio systems, i.e., audio systems having separate audio channels for front and rear speakers, has brought a more realistic and enveloping audio experience to listeners. Such systems, such as Dolby Laboratories Pro-Logic system, may use a matrixing scheme to store four or more separate audio channels on just two audio recording tracks. Upon dematrixing, the Pro-Logic audio system delivers distinct audio signals to a left-front speaker, a right-front speaker, a center speaker, and to surround speakers placed behind a listener.

More recently, surround sound systems have emerged which can deliver completely separate forward and rear audio channels. One such system is Dolby Laboratories five-channel digital system dubbed "AC-3." An audio component which has Dolby AC-3 capability can deliver five discrete channels to speakers placed around a listening environment (left-front, center, right-front, left-surround, and right-surround). Unlike previous surround-sound systems, all five of the distinct channels of the Dolby AC-3 system have full bandwidth capability. This allows for more dynamic and volume range of the rear, or "surround", channels.

The discrete full-bandwidth channels of the Dolby AC-3 system have been touted as increasing localization of stereo sound effects within a sound field. This localization results from the distinct audio channels which feed a separate speaker within the surround sound environment. As a result, sound information can be channeled to any speaker within the system. Moreover, because the AC-3 audio channels are not limited in audio bandwidth, all of the channels can be used for both ambient and direct sound effects.

Although localization of sounds to some extent is beneficial and may greatly increase realism upon audio playback, the capabilities of systems such as Dolby AC-3 and Pro-Logic are limited. For example, a sound field which surrounds a listener can be created by directing sounds to five separate speakers placed around the listener. However, the surround-sound field may be perceived by the listener as containing five discrete point sources from which sounds emanate. In certain surround-sound audio systems, sounds which are intended to move from one rear speaker to another rear speaker may seem, from a listener's perspective, to leap across the rear sound stage. Similarly, sounds which are intended to move from a forward-left speaker to a rear-left speaker may likewise appear to leap across the left sound stage.

Despite the advances in audio reproduction systems, and particularly those having surround sound capability, there is a need for an audio enhancement system which can improve upon the realism of these audio reproduction systems. The audio enhancement system disclosed herein fulfills this need.

SUMMARY OF THE INVENTION

An audio enhancement system and method is disclosed which is particularly designed for surround-sound audio systems such as Dolby's AC-3 five-channel audio system, Dolby's Pro-Logic system, or similar multi-channel audio surround systems. In a typical multi-channel audio enhancement system, four separate audio signals intended for the front and rear speakers are selectively grouped in pairs. Each pair of audio signals is used to generate a pair of component audio signals modified relative to the original pair of audio signals.

The level and type of modification made to the component audio signals may vary to emphasize certain acoustical features of the original audio signals. Individual component audio signals generated from different pairs of original audio signals are then selectively combined to create a composite audio output signal. The composite audio output signal is then fed directly to a speaker for acoustic reproduction. The remaining audio output signals are generated in a similar fashion by combining selected component audio signals. This creates a group of four audio output signals which are enhanced as a function of at least some of the original audio signals.

BRIEF DESCRIPTION OF THE DRAWINGS

The above and other aspects, features, and advantages of the present invention will be more apparent from the following particular description thereof presented in conjunction with the following drawings, wherein.

DETAILED DESCRIPTION OF THE DRAWINGS

Figure 1:
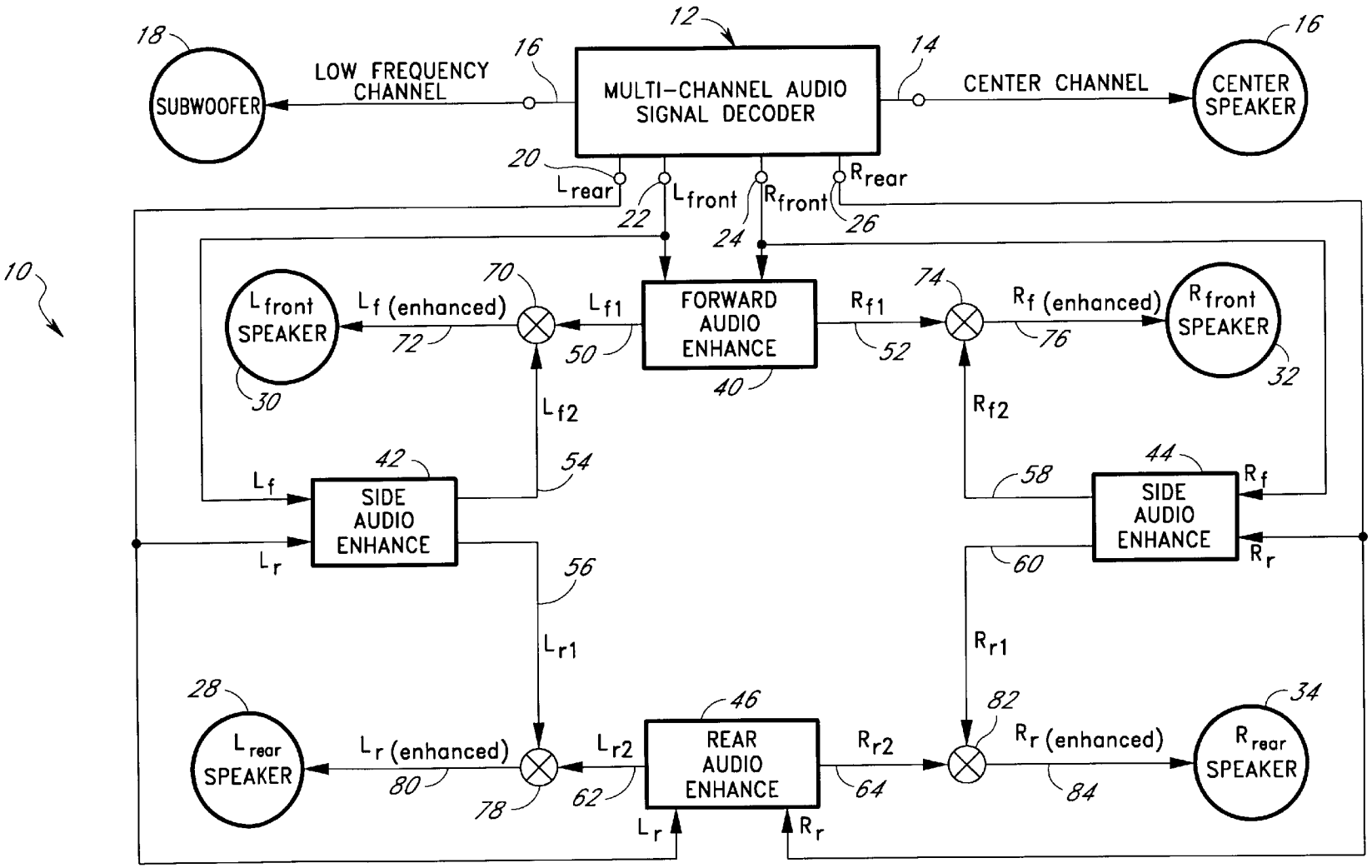
FIG. 1 is a schematic block diagram of an audio enhancement system for use in a surround-sound environment.

FIG. 1 depicts a block diagram of a multi-channel audio enhancement system 10 for use in a surround-sound environment. The audio enhancement system 10 operates in connection with a stereo signal decoder 12 having multi-channel audio source signals. The decoder 12 of FIG. 1 is a six-channel audio decoder which provides audio signals that ultimately drive a group of six speakers. Each of the six audio channels is intended for a different one of the six speakers. In particular, an audio source signal 14, representing the center information (e.g., dialogue), is ultimately directed to a center speaker 16. An audio source signal 18 containing low-frequency sounds is ultimately directed to a subwoofer 20.

The remaining four audio source signals 20, 22, 24, and 26 of the stereo decoder 12 represent the signals ordinarily intended for connection (after amplification) to a left-rear speaker 28, a left-front speaker 30, a right-front speaker 32, and a right-rear speaker 34, respectively. However, as shown in FIG. 1, the audio source signals 20, 22, 24, and 26 are instead selectively routed to a group of audio enhancement devices 40, 42, 44, and 46. In this manner, all of the source signals are isolated in pairs such that no two pairs are identical but two separate pairs may contain the same source signal.

Specifically, a first audio enhancement device 40 receives the left-front source signal 22 ($L_f$), and the right-front source signal 24 ($R_f$). The audio enhancement device 40 outputs a first enhanced component signal 50 ($L_{f1}$) and a second enhanced component signal 52 ($R_{f1}$). In a similar manner but with different inputs, a second audio enhancement device 42 receives the left-rear source signal 20 ($L_r$) and the source signal 22 ($L_f$). In turn, the device 42 outputs first and second component signals 54 ($L_{f2}$), and 56 ($L_{r1}$).

Likewise, a third audio enhancement device 44 receives the source signal 24 ($R_f$) and the right-rear source signal 26 ($R_r$). The device 44 outputs first and second component signals 58 ($R_{f2}$) and 60 ($R_{r1}$). Finally, a fourth audio enhancement device 46 receives the source signal $L_r$ and the source signal 26 ($R_r$). The device 46 outputs first and second component signals 62 ($L_{r2}$) and 64 ($R_{r2}$). For ease of explanation and clarity, the enhancement system 10 is shown having four separate audio enhancement devices 40, 42, 44, and 46. It can be appreciated by one of ordinary skill in the art that the resultant component signals may be generated by a single audio enhancement device receiving all four source signals and modifying them appropriately.

Selected pairs of the component signals (derived from different pairs of source signals) are combined at one of four summing junctions 70, 74, 78, or 82. Specifically, the component signals $L_{f1}$ and $L_{f2}$ are combined at the summing junction 70 to create a composite enhanced output signal 72 ($L_{f(enhanced)}$) for driving the left-front speaker 30. At the summing junction 74, the component signals 52 ($R_{f1}$) and 58 ($R_{f2}$) combine to create a composite enhanced output signal 76 ($_{f(enhanced)}$) for driving the right-front speaker 32. A composite enhanced output signal 80 ($L_{r(enhanced)}$) drives the left-rear speaker 28. The signal $L_{r(enhanced)}$ is generated at the summing junction 78 from component signals $L_{r1}$ and $L_{r2}$. Lastly, the component signals 60 ($R_{r1}$) and 64 ($R_{r2}$) are combined at the summing junction 82 to create a composite enhanced output signal 84 ($R_{r(enhanced)}$). To summarize, $L_{f(enhanced)}=K_1(L_{f1}+L_{f2})$; $R_{f(enhanced)}=K_2(R_{f1}+R_{f2})$; $L_{r(enhanced)}=K_3(L_{r1}+L_{r2})$; and $R_{r(enhanced)}+K_4(R_{r1}+R_{r2})$, where each of the component signals is generated as a function of two audio source signals. The independent variables $K_1$–$K_4$ are determined by the gain, if any, of the summing junctions 70, 74, 78, and 82.

In operation, the audio enhancement system 10 creates a set of four enhanced audio output signals 72, 76, 80, and 84. Each of these four enhanced audio signals is modified as a function of a plurality of the original source signals 20, 22, 24, and 26. The enhancement system 10 operates on the decoded pre-amplified audio source signals which are designated for separate speakers placed within a listening environment. Accordingly, the resultant enhanced output signals 72, 76, 80, and 84 must be amplified before reproduction by the speakers 28, 30, 32, and 34. Audio signal amplifiers are not separately shown in FIG. 1 but may possibly be included in the speakers 28, 30, 32, and 34.

The enhanced output signal $L_{f(enhanced)}$ is generated as a composite of signals $L_{f1}$ and $L_{f2}$. The signal $L_{f1}$ is generated by the audio enhancement device 40 as a function of the two audio source signals $L_f$ and $R_f$. Various audio enhancement apparatus and methods may be used for the device 40. In a preferred embodiment, however, the device 40 creates a signal $L_{f1}$ which, in connection with the signal $R_{f1}$, broadens a perceived spatial image when these signals are played through the speakers 30 and 32, respectively. This creates a more diffuse soundfield between the speakers 30 and 32 and eliminates excessive localization of sound which can detract from realism.

In addition to the component signal $L_{f1}$, a second component signal $L_{f2}$, is generated by the audio enhancement device 42. The signal $L_{f2}$ is generated as a function of the audio source signals 20, $L_r$, and 22, $L_f$. The signal $L_{f2}$ represents one of a pair of audio signals (the other being $L_{r1}$) which, in accordance with a preferred embodiment, generate an enhanced spatial image when amplified and played through the speakers 28 and 30.

Accordingly, the composite enhanced left output signal, $L_{f(enhanced)}$, comprises a portion of the signal $L_{f1}$ and the signal $L_{f2}$. Thus, the acoustics generated through the speaker 30 will be dependent upon both of the audio source signals $L_r$ and $R_f$, which without the enhancement system 10, would be directly connected to the speakers 28 and 32, respectively. The signal $L_{f(enhanced)}$ will thus create an improved spatial image which is dependent on the front audio source signals, $L_f$ and $R_f$, and the left side audio source signals, $L_r$ and $L_f$.

In a similar manner, the composite enhanced output signals $R_{f(enhanced)}$, $L_{r(enhanced)}$, and $R_{r(enhanced)}$, are generated from component signals outputted from the enhancement devices 40, 42, 44, and 46. In particular, the signal $R_{f(enhanced)}$ is a function of the front source signals, $L_f$ and $R_f$, and the right side source signals, $R_f$ and $R_r$; the signal $L_{r(enhanced)}$ is a function of the left side source signals, $L_f$ and $L_r$, and the rear source signals, $L_r$ and $R_r$; and the signal $R_{r(enhanced)}$ is a function of the right side source signals, $R_f$ and $R_r$, and the rear source signals, $L_r$ and $R_r$.

In accordance with the embodiment shown in FIG. 1, each of the audio output signals supplied (after amplification) to a respective one of the speakers 28, 30, 32, and 34 is a function of at least three of the audio source signals 20, 22, 24, and 26. Thus, a given audio output signal played through a speaker becomes dependent upon original source signals intended (before enhancement) for other nearby or adjacent speakers. By blending the output signals in this manner an improved sound experience can be achieved. Depending on the level and type of audio enhancement devices used, the perception of speaker point sources can be eliminated, and instead, a perceived array of loudspeakers is created. Thus, a sound reproduction environment originally intended as a "surround" environment can be made into an environment which envelops or immerses the listener in sound.

In addition to the enhancement of the source signals 20, 22, 24, and 26, the signals 14 and 16 may require level adjustment to balance these signal levels with those of the enhanced source signals 20, 22, 24, and 26. Such level adjustment may be preset and fixed or may be manually adjustable by a user of the system 10. Level control devices are common to one of ordinary skill in the art and would be placed between the decoder 12 and the signal amplifier (not shown) used to power the appropriate speaker.

In some surround sound systems, such as the Dolby Pro-Logic system, there is a single audio signal used to simulate surround effects. This single audio signal is transmitted to both of the rear speakers. In such systems, the signals $L_r$ and $R_r$ of FIG. 1 would be identical and there would be no need for the rear audio enhancement unit 46.

Figure 2:
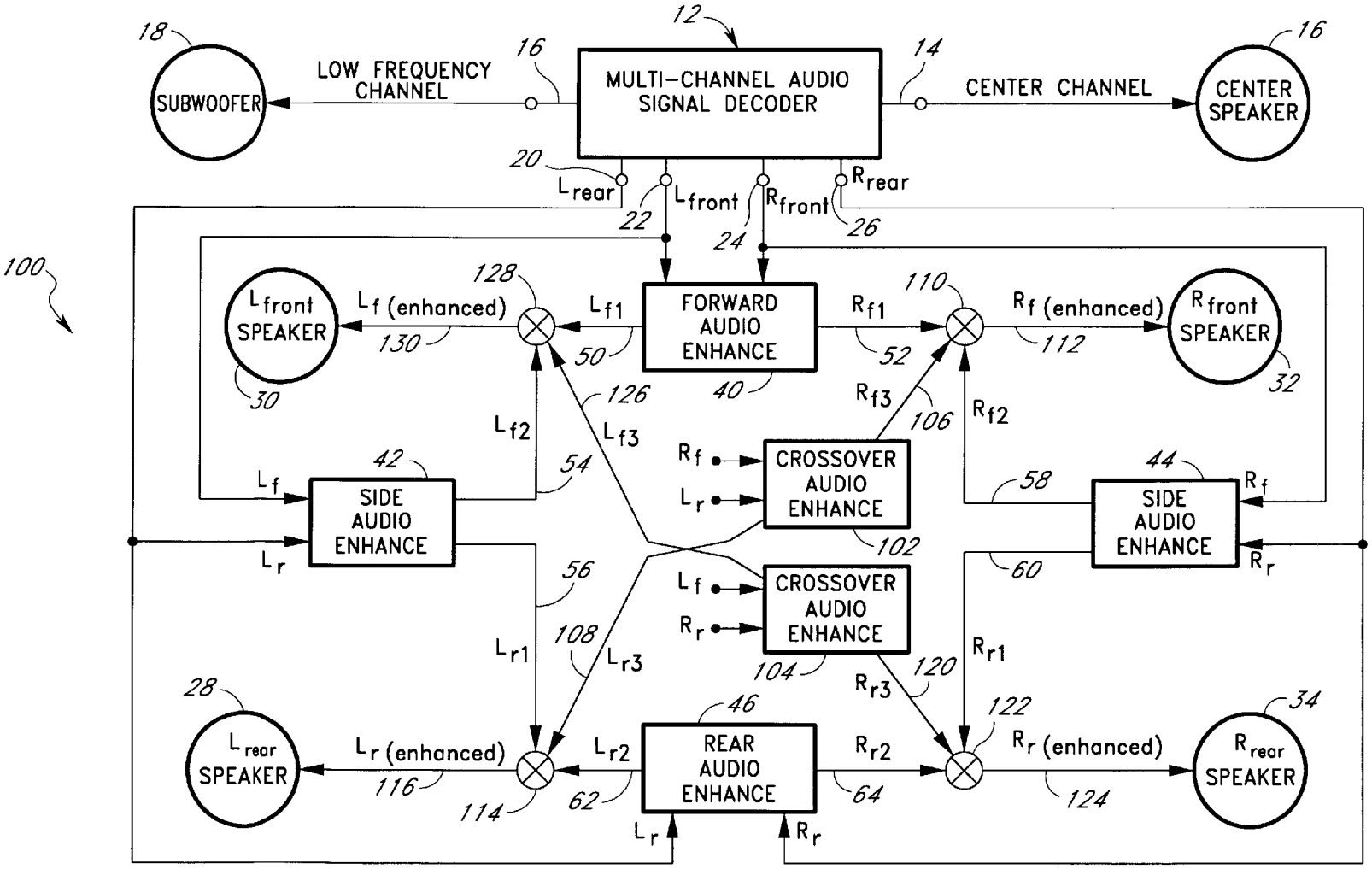
FIG. 2 is a schematic block diagram of an alternative embodiment of an audio enhancement system for use in a surround-sound environment.

FIG. 2 depicts a multi-channel audio enhancement system 100 which employs the techniques just described in connection with FIG. 1. In addition, the enhancement system 100 has two additional audio enhancement devices 102 and 104. Like the other devices 40, 42, 44, and 46, the enhancement devices 102 and 104 provide component signals which contribute to the final audio output signals 72, 76, 80, and 84. The component signals are determined as a function of their respective source signals.

Unlike the other four enhancement devices 40, 42, 44, and 46, the devices 102 and 104 provide crossover audio enhancement. Crossover audio enhancement modifies sounds as a function of those source signals intended for playback by speakers placed diagonally from each other. In particular, the enhancement device 102 inputs the source signals $L_r$ and $R_f$. The resultant component signals $R_{f3}$ and $L_{r3}$ are generated by the device 102. The signal $R_{f3}$ is combined at a summing junction 110 with two other component signals, $R_{f1}$ and $R_{f2}$. This creates a composite output signal 112 ($R_{f(enhanced)}$) which is modified as a function of all four source signals 20, 22, 24, and 26. Similarly, the signal $L_{r3}$ is combined at the junction 114 to generate the composite signal 116 ($L_{r(enhanced)}$) which powers (after amplification) the left-rear speaker 28.

The operation of the second crossover enhancement device 104 is similar to that of the device 102. Specifically, the device 104 receives source signals $L_f$ and $R_r$ intended for diagonally positioned speakers 30 and 34. The device 104 generates a first component signal 120 ($R_{r3}$) which is combined at a summing junction 122 with $R_{r1}$ and $R_{r2}$ to produce the final output signal 124 ($R_{r(enhanced)}$). Likewise, a second component signal 126 is combined at a summing junction 128 with $L_{f1}$ and $L_{f2}$ to produce the final output signal 130 ($L_{f(enhanced)}$).

Figure 3:
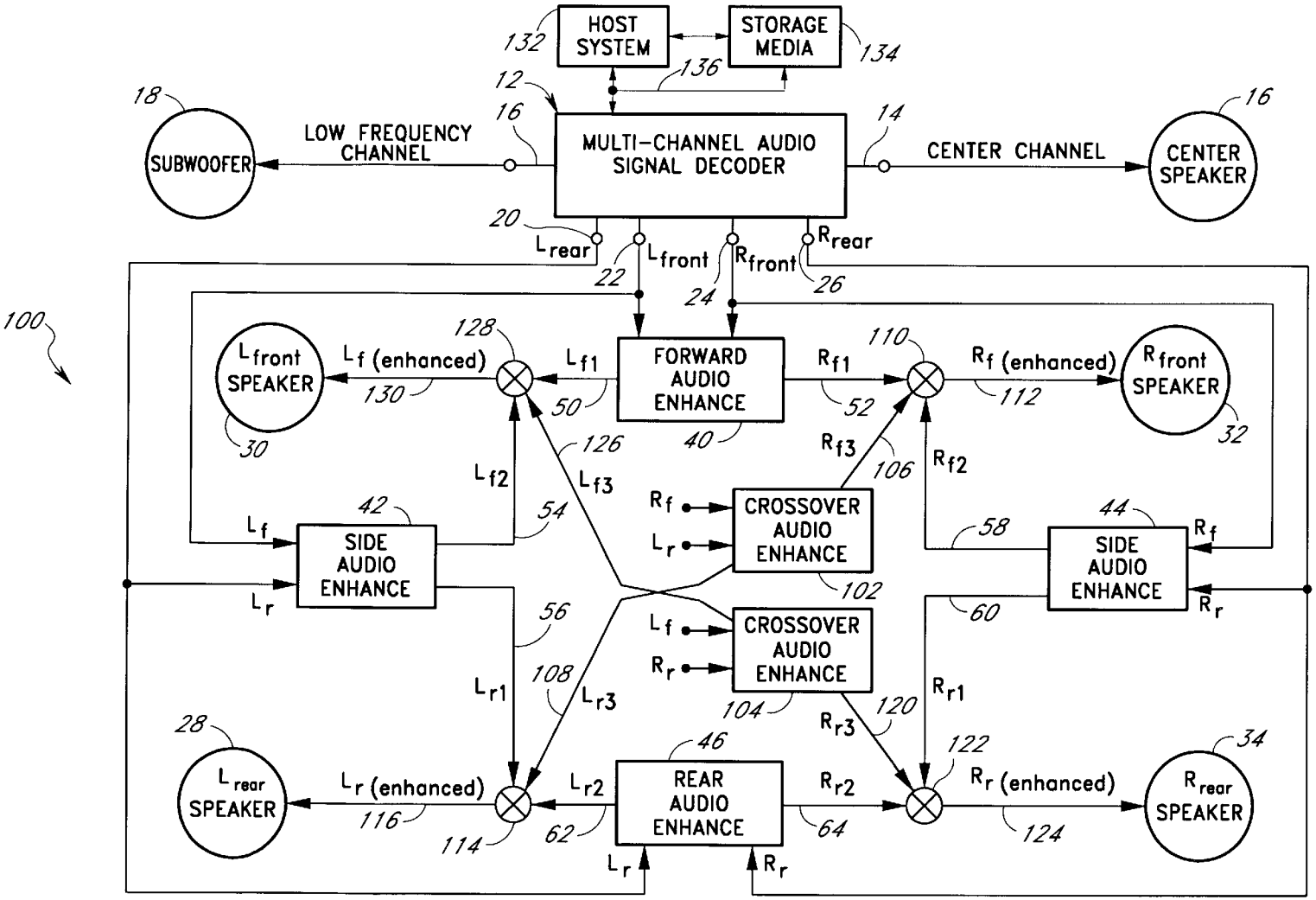
FIG. 3 is a high level block diagram of a preferred audio enhancement system.

FIG. 3 depicts the multi-channel audio enhancement system 10 connected to a host system 132 and a storage media device 134. In the preferred embodiment, the host system 132 is an audio receiver which is compatible with surround systems such as the Dolby Laboratories five-channel digital system dubbed "AC-3." In other embodiments, the host system 132 is an audio receiver which is compatible with Dolby Laboratories' Pro-Logic system. Furthermore, while a multi-channel surround system such as AC-3 is preferred, the present invention is not limited to surround sound systems and can be used to enhance a wide variety of multi-channel sound systems. In other embodiments, for instance the host system 132 may also comprise a laser disk system, a video tape system, a stereo receiver, a television receiver, a computer-based sound system, a digital signal processing system, a Lucasfilm-THX entertainment system or the like.

While the storage media device 134 in the preferred embodiment provides an AC-3 compatible bitstream, other embodiments can use a wide range of storage mediums and storage formats. The format of the AC-3 bitstream is defined by Dolby Laboratories and is well known to those of ordinary skill in the art. Thus, one of ordinary skill in the art will recognize that the storage media device 134 may include a wide variety of optical storage mediums, magnetic storage mediums, computer accessible storage systems or the like. For example, the storage media device 134 may comprise laser disc players, digital video devices, compact discs, video tapes, audio tapes, magnetic recording tracks, floppy disks, hard disks, etc. Furthermore, other embodiments of the storage media device 134 support a wide variety of data formats such as analog frequency modulation, pulse code modulation and the like. In addition, the storage media device 134 may be part of a cable broadcast system, an interactive video device, a computer network, the Internet, a television broadcast system, a high-definition television broadcast system or the like.

In the preferred embodiment, the multi-channel audio signal decoder 12 receives sound data from the host system 132 or the storage media device 134 via a communications bus 136. For example, a composite radio frequency signal containing an AC-3 bitstream is sent from the storage media device to the multi-channel audio signal decoder 12 via the communications bus 136. However, one of ordinary skill in the art will recognize that the communications bus 136 can be configured to carry a wide variety of audio signal formats.

In other embodiments, the host system 132, the storage media device 134, and the communications bus 136 may be integrated into a single device. For example, a digital video device may integrate the host system 132, the storage media device 134 and the communications bus 136. In addition, as discussed in more detail below, other embodiments may integrate the host system 132, the storage media 134 and the systems 10 or 100 with discrete analog components, a semiconductor substrate, through software, within a digital signal processing (DSP) chip, i.e., firmware, or in some other digital format. For example, an audio receiver may contain a digital signal processor which accesses the storage media 134 via communications bus 136, performs host system 134 functions and performs the functions of systems 10 or 100 to produce enhanced signals.

Figure 4A:
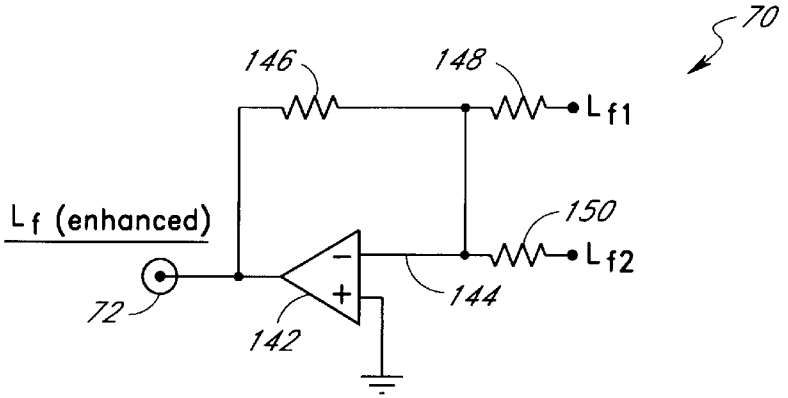
FIG. 4A is a schematic diagram of a summing circuit for use with the invention disclosed in FIG. 1.
Figure 4B:
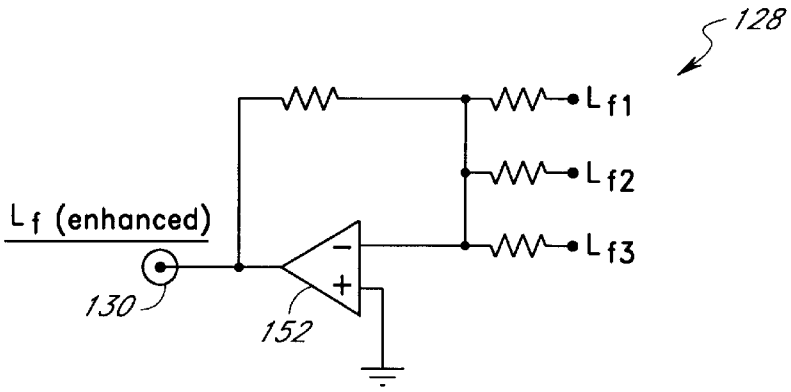
FIG. 4B is a schematic diagram of a summing circuit for use with the invention disclosed in FIG. 2.

FIGS. 4A and 4B depict the summing junctions disclosed in FIGS. 1 and 2. The two-signal summing junction 70 of FIG. 1 is represented by the circuit shown in FIG. 4A. The remaining junctions 74, 78, and 82 are identical to the junction 70 except for the particular input signals received. The summing junction 70 is configured as a standard inverting amplifier having an operational amplifier 142. The amplifier 142 receives the signals $L_{f1}$ and $L_{f2}$. $L_{f1}$ and $L_{f2}$ are then combined, or added together, at an inverting terminal 144 of the amplifier 142. The relative gain of the circuit 70 is determined by the resistors 146, 148 and 150. In a preferred embodiment, the gain for each of the signals $L_{f1}$ and $L_{f2}$ will be unity. However, slight adjustments in gain may be required depending on the particular audio environment and the personal preferences of a listener.

FIG. 4B depicts the summing junction 128 of FIG. 2. The junction 128 and the junction 70 are similarly configured as summing, inverting amplifier circuits. The junction 128, however, has an operational amplifier 152 which combines three inputs, $L_{f1}$, $L_{f2}$, and $L_{f3}$, instead of just two inputs.

The audio enhancement techniques disclosed in FIGS. 1 and 2 improve the immersive effect of a surround sound audio system. The systems 10 and 100 of FIGS. 1 and 2 depict a typical home audio reproduction environment having four primary speakers placed along the front and rear areas of a sound stage. However, the concepts of the present invention are applicable to sound environments having additional speakers which may be placed at any location within a sound stage. For example, speakers may be placed along side walls or even at different elevational levels from one another or with respect to a listener. In addition, the concepts of the present invention can be applied to any pair of audio source signals that may be selected for enhancement. The resultant component signals are then combined with other component signals created from a second pair of audio source signals. This same process may be continued for each possible pair of audio source signals generated by a stereo signal decoder or the like.

The systems 10 and 100 may be implemented in an analog discrete form, in a semiconductor substrate, through software, within a digital signal processing (DSP) chip, i.e., firmware, or in some other digital format.

The multi-channel audio enhancement system 10 of FIG. 1, or the enhancement system 100 of FIG. 2, may employ a variety of audio enhancement devices for generating the component audio signals. For example, the devices 40, 42, 44, 46, 102, and 104 may use time-delay techniques, phase-shift techniques, signal equalization, or a combination of all of these techniques to achieve a desired audio effect. Moreover, the audio enhancement techniques applied by the individual enhancement devices 40, 42, 44, 46, 102, and 104 need not be identical.

In accordance with a preferred embodiment of the present invention, the enhancement devices 40, 42, 44, and 46 of FIG. 1 equalize an ambience signal component found in a pair of stereo signals. As a result, many sounds emanating from a given speaker will not be localized to that speaker. In addition, sounds intended to move across the sound stage from one speaker to another, will do so gradually as if additional speakers were present. The ambience signal component represents the differences between a pair of audio signals. An ambient signal component derived from a pair of audio signals is therefore often referred to as the "difference" signal component.

An example of one audio enhancement device (and methods for implementing same) which is suitable for use with the present invention is discussed in connection with FIGS. 5–8. Such a device broadens and blends a perceived sound stage generated from a pair of stereo audio signals by enhancing the ambient sound information. The audio enhancement device and method disclosed in FIGS. 5–8 is similar to that disclosed in pending application Ser. No. 08/430,751 filed on Apr. 27, 1995, which is incorporated herein by reference as though fully set forth. Related audio enhancement devices are disclosed in U.S. Pat. Nos. 4,738,669 and 4,866,744, issued to Arnold I. Klayman, both of which are also incorporated by reference as though fully set forth herein.

Figure 5:
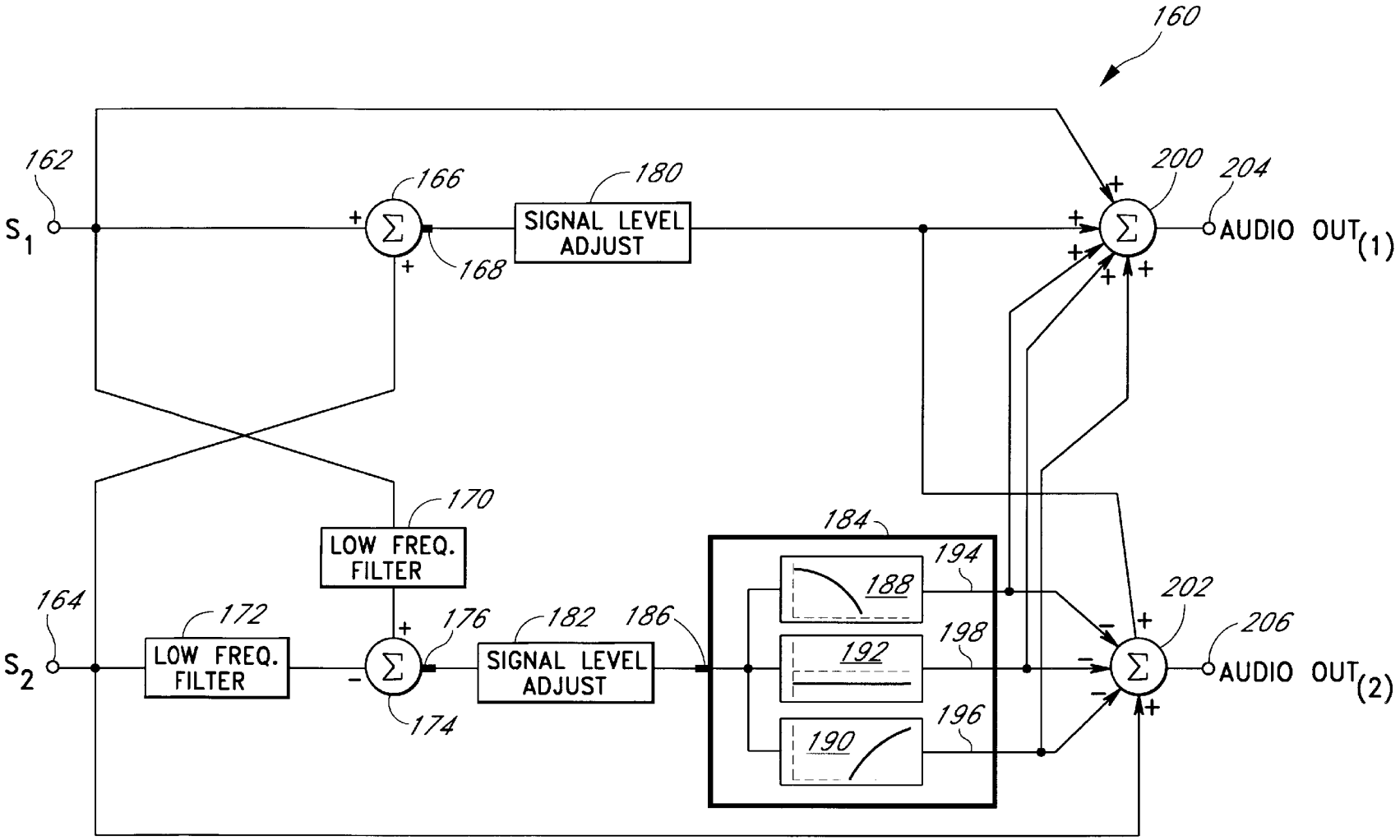
FIG. 5 is a schematic block diagram depicting one type of audio enhancement system which may be used as shown in FIGS. 1 and 2 in order to generate a broadened stereo image.

Referring initially to FIG. 5, a functional block diagram is shown depicting an audio enhancement device 160. In a preferred embodiment of the present invention, the device 160 represents each of the devices 40, 42, 44, 46, 102, and 104. The enhancement system 160 receives first and second stereo source signals ($S_1$ and $S_2$) at inputs 162 and 164, respectively. These stereo source signals are fed to a first summing device 166, e.g., an electronic adder. A sum signal, representing the sum of the stereo source signals received at the inputs 162 and 164, is generated by the summing device 166 at its output 168.

The signal $S_1$ is also connected to an audio filter 170, while the signal $S_2$ is connected to a separate audio filter 172. The outputs of the filters 170 and 172 are fed to a second summing device 174. The summing device 174 generates a difference signal at an output 176. The difference signal represents the ambient information present in the filtered signals $S_1$ and $S_2$. The filters 170 and 172 are pre-conditioning high-pass filters which are designed to avoid over-amplification of the bass components present in the ambient component of a pair of stereo signals.

The summing device 168 and the summing device 174 form a summing network having output signals individually fed to separate level-adjusting devices 180 and 182. The devices 180 and 182 are ideally potentiometers or similar variable-impedance devices. Adjustment of the devices 180 and 182 is typically performed manually by a user to control the base levels of sum and difference signals present in the output signals. This allows a user to tailor the level and aspect of stereo enhancement according to the type of sound reproduced, and depending on the user's personal preferences. An increase in the level of the sum signal emphasizes the audio signals appearing at a center stage positioned between a pair of speakers. Conversely, an increase in the level of difference signal emphasizes the ambient sound information creating the perception of a wider sound image. In some audio arrangements where the parameters of music type and system configuration are known, or where manual adjustment is not practical, the adjustment devices 180 and 182 may be eliminated and the sum and difference-signal levels fixed at a predetermined value.

The output of the device 182 is fed into an equalizer 184 at an input 186. The equalizer 184 spectrally shapes the difference signal appearing at the input 186. This is accomplished by separately applying a low-pass audio filter 188, a high-pass audio filter 190, and an attenuation circuit 192 to the difference signal as shown. Output signals from the filters 188, 190, and the circuit 192 exit the equalizer 184 along paths 194, 196, and 198, respectively.

The modified difference signals transferred along paths 194, 196, and 198 make up the components of a processed difference signal, $(S_1-S_2)_p$. These components are fed into a summing network comprising summing devices 200 and 202. The summing device 200 also receives the sum signal output from the device 180, as well as the original stereo source signal $S_1$. All five of these signals are added within the summing device 200 to produce an enhanced audio output signal 204.

Similarly, the modified difference signals from the equalizer 184, the sum signal, and the signal $S_2$ are combined within the summing device 202 to produce an enhanced audio output signal 206. The components of the difference signal originating along paths 194, 196, and 198 are inverted by the summing device 202 to produce a processed difference signal for one speaker, $(S_2-S_1)_p$, which is 180 degrees out-of-phase from that of the other speaker.

The overall spectral shaping, i.e., normalization, of the ambient signal information occurs as the summing devices 200 and 202 combine the filtered and attenuated components of the difference signal to create the audio output signals 204 and 206. Accordingly, the audio output signals 204 and 206 produce a much improved audio effect because ambient sounds are selectively emphasized to fully encompass a listener within a reproduced sound stage. The audio output signals 204 and 206 are represented by the following mathematical formulas:

$$\text{AUDIO OUT}_{(1)}=S_1+K_1(S_1+S_2)+K_2(S_1-S_2)_p \quad (1)$$

$$\text{AUDIO OUT}_{(2)}=S_2+K_1(S_1+S_2)-K_2(S_1-S_2)_p \quad (2)$$

It should be noted that input signals $S_1$ and $S_2$ in the equations above are typically stereo source signals, but may also be synthetically generated from a monophonic source. One such method of stereo synthesis which may be used with the present invention is disclosed in U.S. Pat. No. 4,841,572, also issued to Arnold Klayman and incorporated herein by reference. Moreover, as discussed in U.S. Pat. No. 4,748,669, the enhanced output signals represented above may be magnetically or electronically stored on various recording media, such as vinyl records, compact discs, digital or analog audio tape, or computer data storage media. Enhanced audio output signals which have been stored may then be reproduced by a conventional stereo reproduction system to achieve the same level of stereo image enhancement.

The signal $(S_1-S_2)_p$ in the equations above represents the processed difference signal which has been spectrally shaped according to the present invention. In accordance with a preferred embodiment, modification of the difference signal is represented by the frequency response depicted in FIG. 6, which is labeled the enhancement perspective, or normalization, curve 210.

The perspective curve 210 is displayed as a function of gain, measured in decibels, against audible frequencies displayed in log format. According to a preferred embodiment, the perspective curve 210 has a peak gain of approximately 7 dB at a point A located at approximately 125 Hz. The gain of the perspective curve 210 decreases above and below 125 Hz at a rate of approximately 6 dB per octave. The perspective curve 210 applies a minimum gain of −2 dB to a difference signal at a point B of approximately 2.1 Khz. The gain increases above 2.1 Khz at a rate of 6 dB per octave up to a point C at approximately 7 Khz, and then continues to increase up to approximately 20 Khz, i.e., approximately the highest frequency audible to the human ear. Although the overall equalization of the perspective curve 210 is accomplished using high-pass and low-pass filters, it is possible to also use a band-rejection filter, having a minimum gain at point B, in conjunction with a high-pass filter to obtain a similar perspective curve.

In a preferred embodiment, the gain separation between points A and B of the perspective curve 210 is ideally designed to be 9 dB, and the gain separation between points B and C should be approximately 6 dB. These figures are design constraints and the actual figures will likely vary from circuit to circuit depending on the actual value of components used. If the signal level devices 180 and 182 are fixed, then the perspective curve 210 will remain constant. However, adjustment of the device 182 will slightly vary the gain separation between points A and B, and points B and C. In a surround sound environment, a gain separation much larger than 9 dB may tend to reduce a listener's perception of mid-range definition.

Implementation of the perspective curve by a digital signal processor will, in most cases, more accurately reflect the design constraints discussed above. For an analog implementation, it is acceptable if the frequencies corresponding to points A, B, and C, and the constraints on gain separation, vary by plus or minus 20 percent. Such a deviation from the ideal specifications will still produce the desired stereo enhancement effect, although with less than optimum results.

Figure 6:
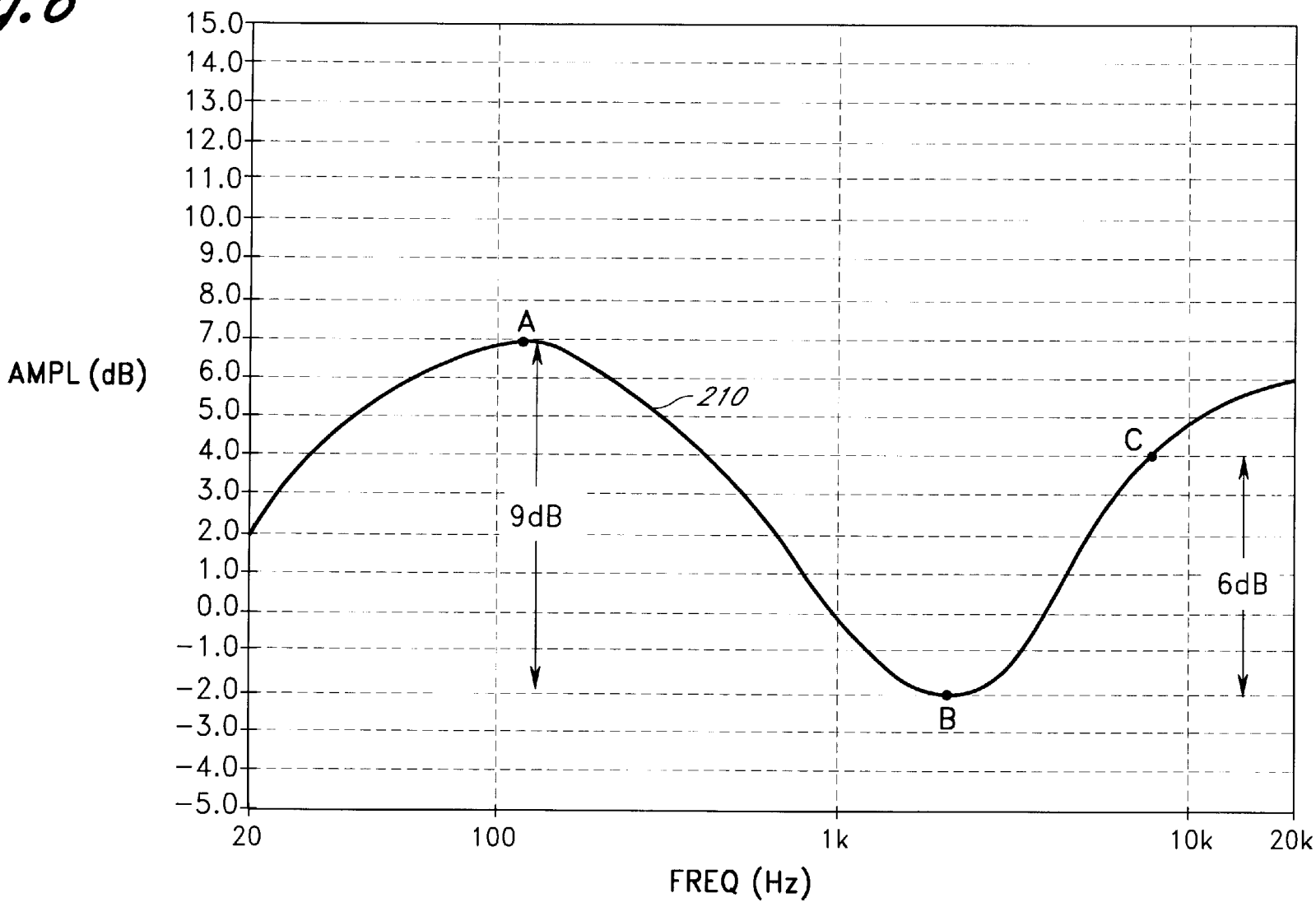
FIG. 6 is a graphical display of the frequency response of an equalization curve, derived from the audio enhancement system of FIG. 4, which is applied to the ambient stereo signal information.

As can be seen in FIG. 6, difference signal frequencies below 125 Hz receive a decreased amount of boost, if any, through the application of the perspective curve 210. This decrease is intended to avoid over-amplification of very low, i.e., bass, frequencies. With many audio reproduction systems, and especially surround sound audio systems, amplifying an audio difference signal in this low-frequency range can create an unpleasurable and unrealistic sound image having too much bass response.

The stereo enhancement provided by the present invention is uniquely adapted to take advantage of high-quality stereo recordings. Specifically, unlike previous analog tape or vinyl album recordings, today's digitally stored sound recordings contain difference signal, i.e. stereo, information throughout a broader frequency spectrum, including the bass frequencies. Excessive amplification of the difference signal within these frequencies is therefore not required to obtain adequate bass response.

Figure 7:
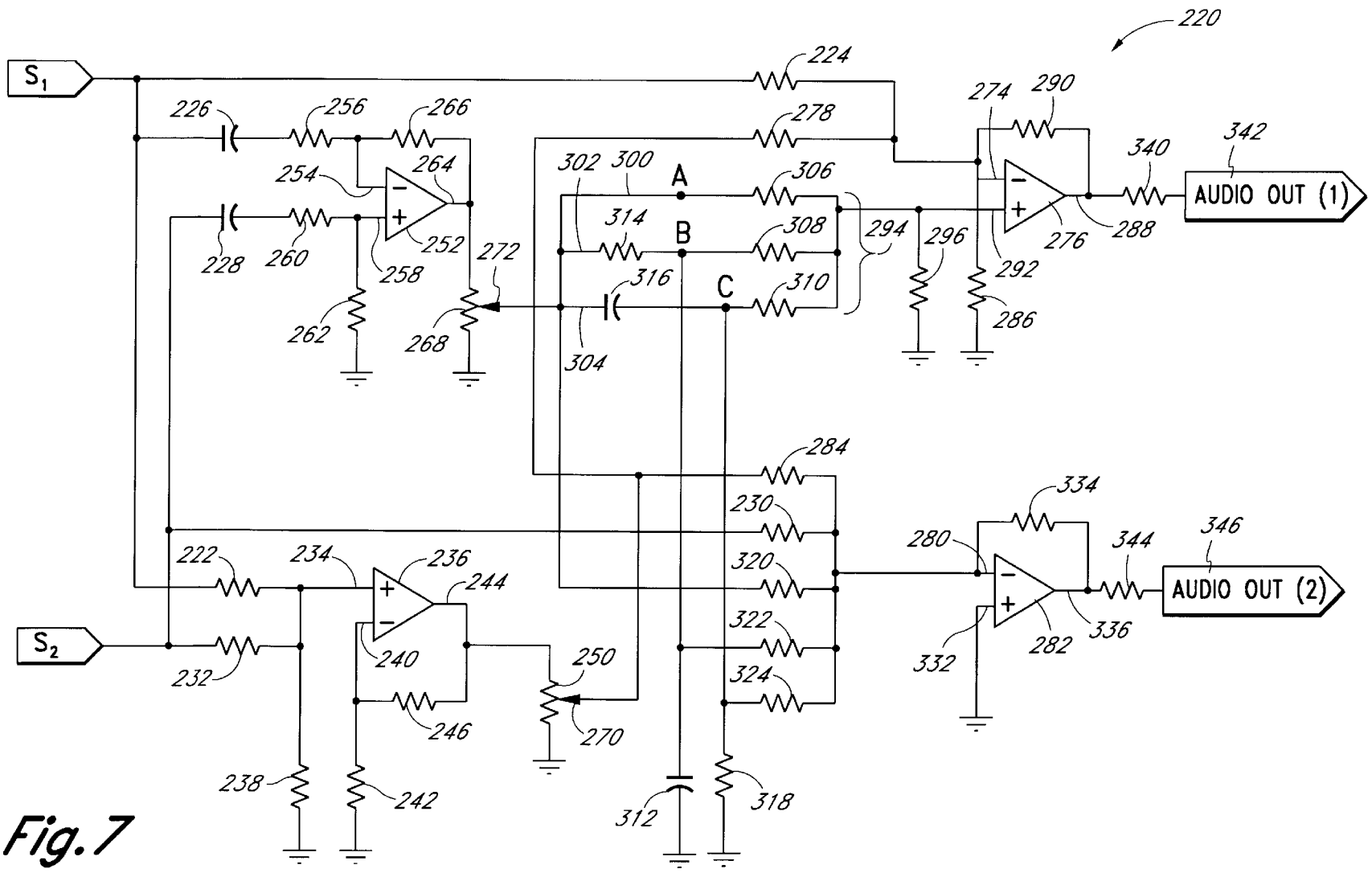
FIG. 7 is a schematic diagram of a first embodiment of the audio enhancement system shown in FIG. 4.

FIG. 7 depicts a circuit 220 for creating a broadened stereo sound image. The audio enhancement circuit 220 corresponds to the device 160 shown in FIG. 5. In FIG. 7, the source signal $S_1$ is fed to a resistor 222, a resistor 224, and a capacitor 226. The source signal $S_2$ is fed to a capacitor 228 and resistors 230 and 232.

The resistor 222 is connected to a non-inverting terminal 234 of an amplifier 236. The same non-inverting terminal 234 is also connected to the resistor 232 and a resistor 238. The amplifier 236 is configured as a summing amplifier having an inverting terminal 240 connected to ground via a resistor 242. An output 244 of the amplifier 236 is connected to the inverting terminal 240 via a feedback resistor 246. A sum signal $(S_1+S_2)$, representing the sum of the first and second source signals, is generated at the output 244 and fed to one end of a variable resistor 250 which is grounded at an opposite end. For proper summing of the source signals $S_1$ and $S_2$ by the amplifier 236, the values of resistors 222, 232, 238, and 246 in a preferred embodiment are 33.2 kohms while resistor 238 is preferably 16.5 kohms.

A second amplifier 252 is configured as a "difference" amplifier. The amplifier 252 has an inverting terminal 254 connected to a resistor 256 which is in turn connected in series to the capacitor 226. Similarly, a positive terminal 258 of the amplifier 252 receives the signal $S_2$ through the series connection of a resistor 260 and the capacitor 228. The terminal 258 is also connected to ground via a resistor 262. An output terminal 264 of the amplifier 252 is connected to the inverting terminal through a feedback resistor 266. The output 264 is also connected to a variable resistor 268 which is in turn connected to ground. Although the amplifier 252 is configured as a "difference" amplifier, its function may be characterized as the summing of the right input signal with the negative left input signal. Accordingly, the amplifiers 236 and 252 form a summing network for generating a sum signal and a difference signal, respectively.

The two series connected RC networks comprising elements 226/256 and 228/260, respectively, operate as high-pass filters which attenuate the very low, or bass, frequencies of the left and right input signals. To obtain the proper frequency response for the perspective curve 210 of FIG. 6, the cutoff frequency, $w_c$, or −3 dB frequency, for the high-pass filters should be approximately 100 Hz. Accordingly, in a preferred embodiment, the capacitors 226 and 228 will have a capacitance of 0.1 micro-farad and the resistors 256, 260 will have an impedance of approximately 33.2 kohms. Then, by choosing values for the feedback resistor 266 and the attenuating resistor 262 such that:

$$\frac{R_{120}}{R_{128}} = \frac{R_{116}}{R_{124}} \tag{3}$$

the output 264 will represent a difference signal, $(S_2-S_1)$, amplified by a gain of two. As a result of the high-pass filtering of the inputs, the difference signal at the output 264 will have attenuated low-frequency components below approximately 125 Hz decreasing at a rate of 6 dB per octave. It is possible to filter the low frequency components of the difference signal within the equalizer 184 (shown in FIG. 5), instead of using the filters 170 and 172 (shown in FIG. 5), to separately filter the input source signals. However, because the filtering capacitors for use at low frequencies must be fairly large, it is preferable to perform this filtering at the input stage to avoid loading of the preceding circuit.

The variable resistors 250 and 268, which may be simple potentiometers, are adjusted by placement of wiper contacts 270 and 272, respectively. The level of the ambience signal component, i.e., difference signal, present in the enhanced output signals may be controlled by manual, remote, or automatic adjustment of the wiper contact 272. Similarly, the level of mono signal component, i.e., sum signal, present in the enhanced output signals is determined in part by the position of the wiper contact 270.

The sum signal present at the wiper contact 270 is fed to an inverting input 274 of a third amplifier 276 through a series-connected resistor 278. The same sum signal at the wiper contact 270 is also fed to an inverting input 280 of a fourth amplifier 282 through a separate series-connected resistor 284. The amplifier 276 is configured as a difference amplifier with the inverting terminal 274 connected to ground through a resistor 286. An output 288 of the amplifier 276 is also connected to the inverting terminal 274 via a feedback resistor 290.

A positive terminal 292 of the amplifier 276 provides a common node which is connected to a group of summing resistors 294 and is also connected to ground via a resistor 296. The level-adjusted difference signal from the wiper contact 272 is transferred to the group of summing resistors 294 through paths 300, 302, and 304. This results in three separately-conditioned difference signals appearing at points A, B, and C, respectively. These conditioned difference signals are then connected to the positive terminal 292 via resistors 306, 308, and 310 as shown.

At point A along the path 300, the level-adjusted difference signal from wiper contact 272 is transferred to the resistor 306 without any frequency-response modification. Accordingly, the signal at point A is merely attenuated by the voltage division between the resistor 306 and the resistor 296. Ideally, the level of attenuation at node A will be −9 dB relative to a 0 dB reference appearing at node B. This level of attenuation is implemented by the resistor 306 having an impedance of 100 kohms and the resistor 296 having an impedance of 21 kohms. The signal at node B represents a filtered version of the level-adjusted difference signal appearing across a capacitor 312 which is connected to ground. The RC network of the capacitor 312 and a resistor 314 operate as a low-pass filter with a cutoff frequency determined by the time constant of the network. In accordance with a preferred embodiment, the cutoff frequency, or −3 dB frequency, of this low-pass filter is approximately 200 Hz. Accordingly, the resistor 314 is preferably 1.5 kohms and the capacitor 312 0.47 microfarads, the drive resistor 308 is 33.2 kohms, and the feedback resistor 290 is 121 kohms.

In surround sound audio systems, there is often an abundance of bass or low-frequency information resulting from the subwoofer and the additional speakers. Therefore, it may be desirable to separately control the level of low-frequency difference signal appearing at node B. As should be apparent to one of ordinary skill in the art, this can be accomplished by connecting the output 264 of the amplifier 252 to a second variable gain resistor which, instead of the wiper contact 272, directly drives the resistor 314. In this manner, the time constant of the low-pass filter is maintained and the lower frequencies of the difference signal can be more precisely and directly controlled.

At node C, a high-pass filtered difference signal is fed through the drive resistor 310 to the non-inverting terminal 292 of the amplifier 276. The high-pass filter is designed with a cutoff frequency of approximately 7 Khz and a relative gain to node B of −6 dB. Specifically, a capacitor 316 connected between node C and the wiper contact 272 has a value of 4700 picofarads, and a resistor 318 connected between node C and ground has a value of 3.74 kohms.

The modified difference signals present at circuit locations A, B, and C are also fed into the inverting terminal 280 of the amplifier 282 through resistors 320, 322 and 324, respectively. The amplifier 282 is configured as an inverting amplifier having a positive terminal 332 connected to ground and a feedback resistor 334 connected between the terminal 280 and an output 336. To achieve proper summing of the signals by the inverting amplifier 282, the resistor 320 has an impedance of 100 kohms, the resistor 322 has an impedance of 33.2 kohms, and the resistor 324 has an impedance of 44.2 kohms. The exact values of the resistors and capacitors in the audio enhancement system 220 may be altered as long as the proper ratios are maintained to achieve the correct level of enhancement. Other factors which may affect the desired value of the passive components are the power requirements of the enhancement system 220 and the characteristics of the amplifiers 236, 252, 276, and 282.

In operation, the modified difference signals are recombined to generate output signals comprised of a processed difference signal. Specifically, difference signal components found at points A, B, and C are recombined at the terminal 292 of the difference amplifier 276, and at the terminal 280 of the amplifier 282, to form a processed difference signal $(S_1-S_2)_p$. The signal $(S_1-S_2)_p$ represents the difference signal which has been equalized through application of the perspective curve 210 of FIG. 6. Ideally then, the perspective curve is characterized by a gain of 4 db at 7 Khz, a gain of 7 dB at 125 Hz, and a gain of −2 dB at 2100 Hz.

The amplifiers 276 and 282 operate as mixing amplifiers which combine the processed difference signal with the sum signal and either the left or right input signal. The signal at the output 288 of the amplifier 276 is fed through a drive resistor 340 to produce an enhanced audio output signal 342. Similarly, the signal at the output 336 of the amplifier 282 travels through a drive resistor 344 to produce an enhanced audio output signal 346. The drive resistors will typically have an impedance on the order of 200 ohms. The enhanced output signals 342 and 346 can be expressed by the mathematical equations (1) and (2) recited above. The value of $K_1$ in equations (1) and (2) is controlled by the position of the wiper contact 270 and the value of $K_2$ is controlled by the position of the wiper contact 272.

All of the individual circuit components depicted in FIG. 7 may be implemented digitally through software run on a microprocessor, or through a digital signal processor. Accordingly, an individual amplifier, an equalizer, or other components, may be realized by a corresponding portion of software or firmware.

Figure 8:
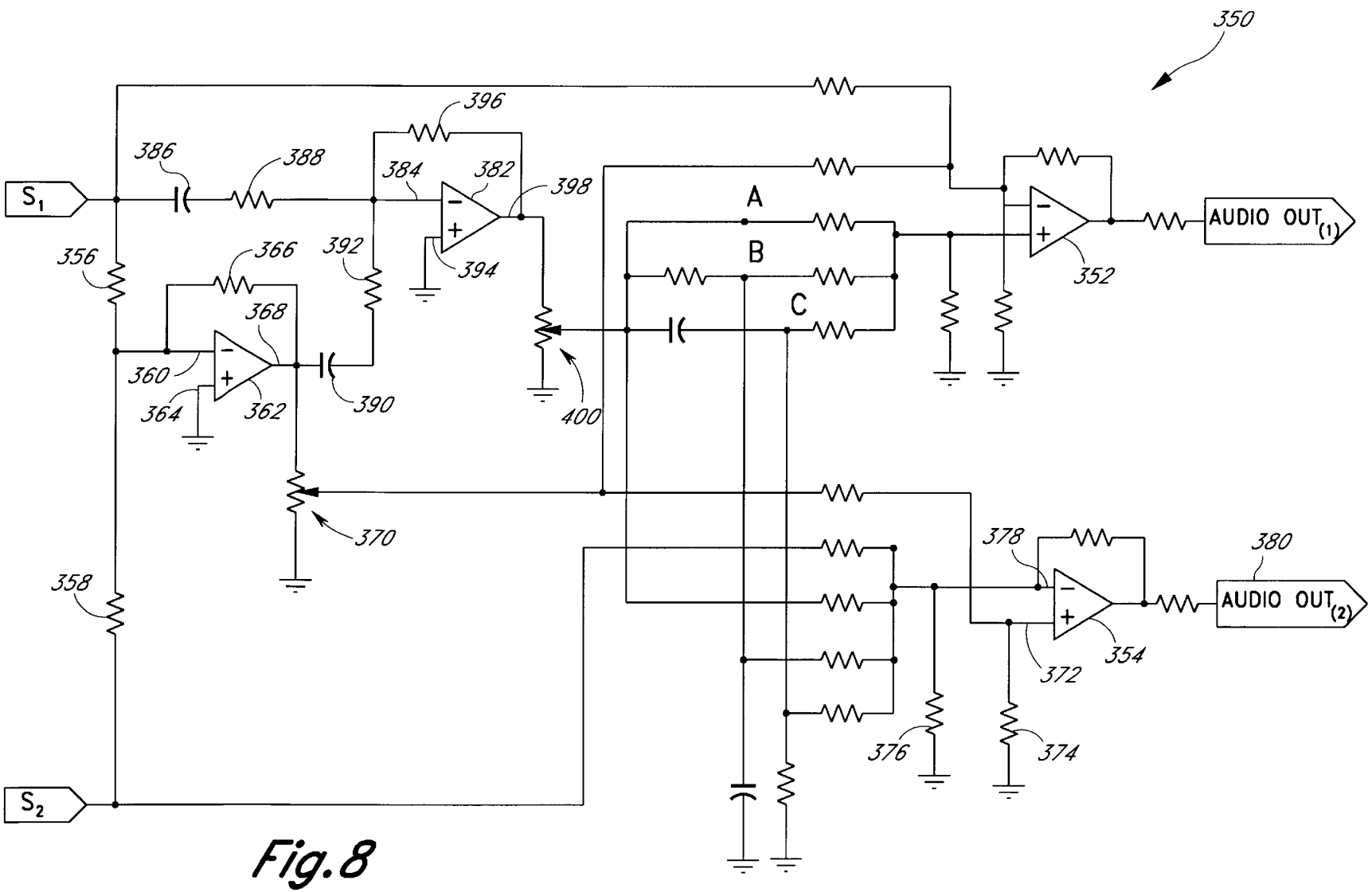
FIG. 8 is a schematic diagram of a second embodiment of the audio enhancement system shown in FIG. 4.

An alternative embodiment of the audio enhancement device 220 is depicted in FIG. 8. The device 350 of FIG. 8 is similar to that of FIG. 7 and represents another method for applying the perspective curve 210 (shown in FIG. 6) to a pair of stereo audio signals. The audio enhancement system 350 utilizes an alternative summing network configuration for generating a sum and difference signal.

In the alternative embodiment 350, the audio source signals $S_1$ and $S_2$ are ultimately fed into the negative input of mixing amplifiers 352 and 354. To generate the sum and difference signals, however, the signals $S_1$ and $S_2$ are first fed through resistors 356 and 358, respectively, and into an inverting terminal 360 of a first amplifier 362. The amplifier 362 is configured as an inverting amplifier with a grounded input 364 and a feedback resistor 366. The sum signal, or in this case the inverted sum signal −(L+R), is generated at an output 368. The sum signal component is then fed to the remaining circuitry after being level-adjusted by the variable resistor 370. Because the sum signal in the alternative embodiment is now inverted, it is fed to a non-inverting input 372 of the amplifier 354. Accordingly, the amplifier 354 requires a current-balancing resistor 374 placed between the non-inverting input 372 and ground potential. Similarly, a current-balancing resistor 376 is placed between an inverting input 378 and ground potential. These slight modifications to the amplifier 354 in the alternative embodiment are necessary to achieve correct summing to generate the enhanced audio output signal 380.

To generate a difference signal, an inverting summing amplifier 383 receives the signal $S_1$ and the sum signal at an inverting input 384. More specifically, the source signal $S_1$ is passed through a capacitor 386 and a resistor 388 before arriving at the input 384. Similarly, the inverted sum signal at the output 368 is passed through a capacitor 390 and a resistor 392. The RC networks created by components 386/388 and components 390/392 provide the bass frequency filtering of the audio signal as described in conjunction with a preferred embodiment.

The amplifier 382 has a grounded non-inverting input 394 and a feedback resistor 396. A difference signal, $S_2-S_1$ is generated at an output 398 with impedance values of 100 kohm for the resistors 356, 358, 366, and 388, impedance values of 200 kohms for the resistors 392 and 396, a capacitance of 0.15 micro-farads for the capacitor 390, and a capacitance of 0.33 micro-farads for the capacitor 386. The difference signal is then adjusted by the variable resistor 400 and fed into the remaining circuitry. Except as described above, the remaining circuitry of FIG. 8 is the same as that of a preferred embodiment disclosed in FIG. 7.

The entire audio enhancement system 220 of FIG. 7 uses a minimum of components. The system 220 may be constructed with only four active components, typically operational amplifiers corresponding to amplifiers 236, 252, 276, and 282. These amplifiers are readily available as a quad package on a single semiconductor chip. Additional components needed to construct the audio enhancement system 220 include only 29 resistors and 4 capacitors. The system 350 of FIG. 8 can also be manufactured with a quad amplifier, 4 capacitors, and only 29 resistors, including the potentiometers and output resistors. Because of its unique design, the audio enhancement systems 220 and 350 can be produced at minimal cost utilizing minimal component space and still provide unbelievable broadening of an existing stereo image. In fact, the entire system 220 can be formed as a single semiconductor substrate, or integrated circuit.

Apart from the embodiments depicted in FIGS. 7 and 8, there are conceivably additional ways to interconnect the same components and obtain perspective enhancement of stereo signals as described herein. For example, a pair of amplifiers configured as difference amplifiers may receive a pair of source signals, respectively, and may also each receive the sum signal. In this manner, the amplifiers would generate a first difference signal, L−R, and a second difference signal, R−L, respectively.

In addition, still other embodiments of audio enhancement devices may not separately generate a difference signal at all. Of main importance is the fact that ambient information, information represented by a difference signal, is properly equalized. This can be accomplished in any number of ways without specifically generating a difference signal. For example, the isolation of the difference signal information and its subsequent equalization may be performed digitally, or performed simultaneously at the input stage of an amplifier circuit.

The perspective modification of the difference signal resulting from the enhancement systems 220 and 350 has been carefully engineered to achieve optimum results for a wide variety of applications and inputted audio signals. Adjustments by a user currently include only the level of sum and difference signals applied to the conditioning circuitry. However, it is conceivable that potentiometers could be used in place of resistors 314 and 318 to allow for adaptive equalization of the difference signal.

Other audio enhancement apparatus and methods which may be used as the devices 40, 42, 44, 46, 102, and 104 include time-delay techniques as disclosed in U.S. Pat. No. 4,355,203 (incorporated herein by reference as though fully set forth), and phase-shifting techniques as disclosed in U.S. Pat. No. 5,105,462 (incorporated herein by reference as though fully set forth).

Through the foregoing description and accompanying drawings, the present invention has been shown to have important advantages over current stereo reproduction and enhancement systems. While the above detailed description has shown, described, and pointed out the fundamental novel features of the invention, it will be understood that various omissions and substitutions and changes in the form and details of the device illustrated may be made by those skilled in the art, without departing from the spirit of the invention. Therefore, the invention should be limited in its scope only by the following claims.

What is claimed is:

1. An audio enhancement device which broadens the perceived spatial image of sound signals in a surround sound environment, said audio enhancement system comprising:

a left-front audio signal;

a right-front audio signal;

a left-rear audio signal;

a right-rear audio signal;

a front enhancer in communication with said left-front audio signal and said right-front audio signal, said front enhancer configured to modify the ambient information in said left-front audio signal and said right-front audio signal in a manner which generates a plurality of front component signals;

a left enhancer in communication with said left-front audio signal and said left-rear audio signal, said left enhancer configured to modify the ambient information in said left-front audio signal and said left-rear audio signal in a manner which generates a plurality of left component signals;

a rear enhancer in communication with said left-rear audio signal and said right-rear audio signal, said rear enhancer configured to modify the ambient information in said left-rear audio signal and said right-rear audio signal in a manner which generates a plurality of rear component signals;

a right enhancer in communication with said right-rear audio signal and said right-front audio signal, said right enhancer configured to modify the ambient information in said right-rear audio signal and said right-front audio signal in a manner which generates a plurality of right component signals;

a left-front junction configured to combine one of said left component signals and one of said front component signals to generate a left-front output signal;

a left-rear junction configured to combine one of said left component signals and one of said rear component signals to generate a left-rear output signal;

a right-rear junction configured to combine one of said right component signals and one of said rear component signals to generate a right-rear output signal; and a right-front junction configured to combine one of said right component signals and one of said front component signals to generate a right-front output signal.

2. The audio enhancement device of claim 1 further comprising a first crossover enhancer, said first crossover enhancer in communication with said right-front audio signal and said left-rear audio signal, said first crossover enhancer configured to modify the ambient information in said right-front audio signal and said left-rear audio signal in a manner which generates a first crossover component signal and a second crossover component signal.

3. The audio enhancement device of claim 2 wherein said right-front junction is further configured to combine said first crossover component signal, one of said right component signals and one of said front component signals to generate said right-front output signal.

4. The audio enhancement device of claim 2 wherein said left-rear junction is further configured to combine said second crossover component signal, one of said left component signals and one of said rear component signals to generate said left-rear output signal.

5. The audio enhancement device of claim 2 further comprising a second crossover enhancer, said second crossover enhancer in communication with said left-front audio signal and said right-rear audio signal, said second crossover enhancer configured to modify the ambient information in said left-front audio signal and said right-rear audio signal in a manner which generates a third crossover component signal and a fourth crossover component signal.

6. The audio enhancement device of claim 5 wherein said left-front junction is further configured to combine said third crossover component signal, one of said left component signals and one of said front component signals to generate said left-front output signal.

7. The audio enhancement device of claim 5 wherein said right-rear junction is further configured to combine said fourth crossover component signal, one of said right component signals and one of said rear component signals to generate said right-rear output signal.

8. An audio enhancement device which broadens the perceived spatial image of sound signals, said audio enhancement device comprising:

at least first, second and third audio source signals;

at least two audio enhancers, said first audio enhancer in communication with said first and second audio source signals, said second audio enhancer in communication with said second and third audio source signals, said audio enhancers configured to process information in said pair of audio source signals in a manner which generates a plurality of processed signals; and at least one combining junction in communication with at least two of said processed signals, said combining junction configured to combine said processed signals to generate at least one output audio signal.

9. The audio enhancement device of claim 8 wherein at least one of said audio enhancers modifies ambient information in said audio signals by inserting a time delay within said ambient information.

10. The audio enhancement device of claim 8 wherein at least one of said audio enhancers modifies ambient information in said audio signals by phase shifting said ambient information.

11. The audio enhancement device of claim 8 wherein at least one of said audio enhancers modifies ambient information in said audio signals by selectively emphasizing relative amplitudes in said ambient information.

12. The audio enhancement device of claim 8 wherein said combining junction adds said processed signals together to generate said plurality of output signals.

13. The audio enhancement device of claim 8 wherein said combining junction comprises an inverting amplifier.

14. The audio enhancement device of claim 8 wherein said combining junction comprises an operational amplifier.

15. A computer system which broadens the perceived spatial image of sound signals, said computer system comprising:

a computer processor configured to access audio data stored on a computer accessible storage medium, said computer processor further configured to transfer said audio data to a data bus;

an audio decoder in communication with said data bus, said audio decoder configured to generate first, second, and third audio source signals;

at least two audio enhancers, said first audio enhancer in communication with said first and second audio source signals, said second audio enhancer in communication with said second and third audio source signals, said audio enhancers configured to modify the information in said audio source signals in a manner which generates a plurality of processed signals; and at least one combining junction in communication with at least two of said processed signals, said combining junction configured to combine said processed signals to generate at least one output audio signal.

16. The computer system of claim 15 wherein said audio decoder is a digital signal processor.

17. The computer system of claim 15 wherein said audio signals are AC-3 compatible audio signals.

18. The computer system of claim 15 wherein each of said four audio signals corresponds to a discrete, full bandwidth audio channel.

19. The computer system of claim 15 wherein said computer accessible storage medium is a hard disk.

20. The computer system of claim 15 wherein said computer accessible storage medium is a compact disk.

21. the computer system of claim 15 wherein said computer accessible storage medium is a laser disk.

22. An audio enhancement system for use in a surround sound reproduction environment wherein the surround sound environment has at least four separate audio source signals designated for speakers situated within the reproduction environment and placed around a listener, the audio enhancement system modifying the audio source signals to generate at least four enhanced output signals for creating an immersive sound experience for the listener when the enhanced output signals are amplified and played through the speakers, the audio enhancement system comprising:

a first enhancement device receiving a first pair of said audio source signals, said first enhancement device modifying said first pair of source signals to create first and second component signals representative of said first pair of source signals;

a second enhancement device receiving a second pair of said audio source signals, said second enhancement device modifying said second pair of source signals to create third and fourth component signals representative of said second pair of source signals;

a third enhancement device receiving a third pair of said audio source signals, said third enhancement device modifying said third pair of source signals to create fifth and sixth component signals representative of said third pair of source signals;

a fourth enhancement device receiving a fourth pair of said audio source signals, said fourth enhancement device modifying said fourth pair of source signals to create seventh and eighth component signals representative of said fourth pair of source signals;

means for combining said component signals to generate said at least four enhanced output signals for providing an immersive and realistic sound field for a listener, said at least four enhanced output signals comprising:

a first output signal representing a composite of said first component signal and said third component signal;

a second output signal representing a composite of said second component signal and said fifth component signal;

a third output signal representing a composite of said fourth component signal and said seventh component signal; and a fourth output signal representing a composite of said sixth component signal and said eighth component signal.

23. The audio enhancement system of claim 22 wherein said at least four audio source signals comprise a signal, $L_f$, designated for a left-front speaker; a signal, $R_f$, designated for a right-front speaker; a signal, $L_r$, designated for a left-rear speaker; and a signal, $R_R$, designated for a right-rear speaker.

24. The audio enhancement system of claim 23 wherein said first pair of source signals comprises the signals $L_f$ and $R_f$; said second pair of source signals comprises the signals $L_f$ and $L_r$; said third pair of source signals comprises the signals $R_f$ and $R_r$; and said fourth pair of source signals comprises the signals $L_r$ and $R_r$.

25. The audio enhancement system of claim 22 wherein said means for combining said component signals is an electronic adder.

26. The audio enhancement system of claim 22 further comprising:

a fifth enhancement device receiving a fifth pair of said audio source signals, said fifth enhancement device modifying said fifth pair of source signals to create ninth and tenth component signals representative of said fifth pair of source signals;

a sixth enhancement device receiving a sixth pair of said audio source signals, said sixth enhancement device modifying said sixth pair of source signals to create eleventh and twelfth component signals representative of said sixth pair of source signals; and wherein:

said first output signal represents a composite of said first component signal, said third component signal, and said eleventh component signal;

said second output signal represents a composite of said second component signal, said fifth component signal, and said tenth component signal;

said third output signal represents a composite of said fourth component signal, said seventh component signal, and said ninth component signal; and said fourth output signal represents a composite of said sixth component signal, said eighth component signal, and said twelfth component signal.

27. The audio enhancement system of claim 22 wherein said first, second, third, and fourth enhancement devices modify said corresponding pairs of source signals by selectively emphasizing the ambient information within said corresponding pairs of source signals.

28. The audio enhancement system of claim 22 wherein said audio enhancement system if formed upon a semiconductor substrate.

29. The audio enhancement system of claim 22 wherein said audio enhancement system is implemented by a digital signal processor.

30. The audio enhancement system of claim 22 wherein each of said output signals is amplified and directed to a plurality of speakers situated around a listener within the surround sound environment.

31. A method of enhancing sound in a surround sound reproduction environment wherein the surround sound environment has at least four separate audio source signals designated for speakers situated within the reproduction environment and placed around a listener, the method of enhancing comprising the following steps:

providing four audio source signals generated from a stereo signal decoder during playback of a recorded audio signal; and modifying different combinations of said four audio source signals to create four enhanced audio signals wherein each of said four enhanced audio signals is modified as a function of at least three of said audio source signals, said enhanced audio signals creating an immersive sound experience for the listener when the enhanced audio signals are played through speakers of a reproduction environment.

32. The method of claim 31 further comprising the additional step of amplifying said enhanced audio signals to allow for reproduction by speakers within the surround sound reproduction environment.

33. The method of claim 31 wherein each of said audio source signals is modified as a function of said at least two additional source signals to create two component signals, and wherein said component signals which correspond to a common audio source signal are combined to form said enhanced audio signals.

34. A method of enhancing a group of audio source signals generated for playback in a surround sound environment wherein the audio source signals are designated for speakers placed around a listener, the audio source signals comprising a left-front signal ($L_f$), a right-front signal ($R_f$), a left-rear signal ($L_r$), and a right-rear signal ($R_r$), the method of enhancing comprising the following steps:

generating first and second component signals from the source signals $L_f$ and $R_f$ wherein the first and second component signals are modified as a function of the source signals $L_f$ and $R_f$, the first component signal corresponding to the signal $L_f$ and the second component signal corresponding to the signal $R_f$;

generating third and fourth component signals from the source signals $L_f$, and $L_r$ wherein the third and fourth component signals are modified as a function of the source signals $L_f$ and $L_R$, the third component signal corresponding to the signal $L_f$ and the fourth component signal corresponding to the signal $L_r$;

generating fifth and sixth component signals from the source signals $R_f$ and $R_r$ wherein the fifth and sixth component signals are modified as a function of the source signals $R_f$ and $R_r$, the fifth component signal corresponding to the signal $R_f$ and the sixth component signal corresponding to the signal $R_r$;

generating seventh and eighth component signals from the source signals $L_r$ and $R_r$ wherein the seventh and eighth component signals are modified as a function of the source signals $L_r$ and $R_r$, the seventh component signal corresponding to the signal $L_r$ and the eighth component signal corresponding to the signal $R_r$;

combining the first and third component signals to generate a composite and enhanced left-front output signal, $L_{f(enhanced)}$, for reproduction in said surround sound environment;

combining the second and fifth component signals to generate a composite and enhanced right-front output signal, $R_{f(enhanced)}$, for reproduction in said surround sound environment;

combining the fourth and seventh component signals to generate a composite and enhanced left-rear output signal, $L_{r(enhanced)}$, for reproduction in said surround sound environment; and combining the sixth and eighth component signals to generate a composite and enhanced right-rear output signal, $R_{r(enhanced)}$, for reproduction in said surround sound environment.

35. The method of enhancing a group of audio source signals as recited in claim 34 wherein each of said eight component signals contains ambient signal information which has been equalized, relative to ambient information in said corresponding source signal, to obtain a broader perceived sound stage with respect to any two of said enhanced output signals.

36. A method of enhancing a group of audio source signals generated for playback in a surround sound environment wherein the audio source signals are designated for speakers placed around a listener, the audio source signals comprising a left-front signal ($L_f$), a right-front signal ($R_f$), a left-rear signal ($L_r$), and a right-rear signal ($R_r$), said method of enhancing comprising modifying said audio source signals to create four corresponding enhanced audio signals wherein each of the four enhanced audio signals is modified as a function of its corresponding audio source signal and at least two additional audio source signals in accordance with the following equations:

$$L_{f(enhanced)}=K_1(M_1(L_f, R_f)+M_2(L_f, L_r)),$$

$$R_{f(enhanced)}=K_2(M_3(L_f, R_f)+M_4(R_f, R_r)),$$

$$L_{r(enhanced)}=K_3(M_5(L_f, L_r)+M_6(L_r, R_r)),$$

and $$R_{r(enhanced)}=K_4(M_7(R_f, R_r)+M_8(L_r, R_r)),$$

where $M_1$–$M_8$ are independent variables which dictate the level and type of modification to the audio source signals, and $K_1$–$K_4$ are independent variables which determine the gain of the enhanced audio signals.

37. The method of enhancing a group of audio source signals as recited in claim 36 wherein the independent variables $M_1$–$M_8$ represent equalization of ambient audio information present in the corresponding audio source signals.

* * * * *